US006331847B1

(12) United States Patent
Kim et al.

(10) Patent No.: US 6,331,847 B1
(45) Date of Patent: Dec. 18, 2001

(54) THIN-FILM TRANSISTOR LIQUID CRYSTAL DISPLAY DEVICES THAT GENERATE GRAY LEVEL VOLTAGES HAVING REDUCED OFFSET MARGINS

(75) Inventors: Chang-oon Kim, Kyungki-do; Kyune-hee Lee, Seoul, both of (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/290,375

(22) Filed: Apr. 12, 1999

(30) Foreign Application Priority Data

Apr. 13, 1998 (KR) ..... 98-13127

(51) Int. Cl.[7] ..... G09G 3/36

(52) U.S. Cl. ..... 345/100; 345/89; 345/98; 345/99

(58) Field of Search ..... 345/89, 95, 98, 345/99, 97, 147, 100, 92; 340/347

(56) References Cited

U.S. PATENT DOCUMENTS 5,196,738 * 3/1993 Takahara et al. ..... 340/347
5,243,333 * 9/1993 Shiba et al. ..... 345/100
5,638,091 * 6/1997 Sarrasin ..... 345/147
5,793,346 8/1998 Moon ..... 345/92
5,808,706 9/1998 Bae ..... 349/38
5,815,129 9/1998 Jung ..... 345/93
6,014,122 * 1/2000 Hashimoto ..... 345/98
6,157,360 * 12/2000 Jeong et al. ..... 345/98

FOREIGN PATENT DOCUMENTS 5289053 11/1993 (JP) .
8122733 5/1996 (JP) .

OTHER PUBLICATIONS

Notice to Submit response, Koren Application No. 10–1998–0013127, May 31, 2000.

* cited by examiner

*Primary Examiner*—Chanh Nguyen
*Assistant Examiner*—Fritz Alphonse
(74) *Attorney, Agent, or Firm*—Myers Bigel Sibley & Sajovec

(57) ABSTRACT

TFT-LCD devices having improved data line driver circuits therein comprise an follower amplifier which drives a data line of a panel "hard" during a first portion of a selection time interval (when a strong pull-up or pull-down is required) and a transmission gate which performs a "soft" pull-up or pull-down of the data line to a desired gray level voltage during a second portion of the selection time interval. The "soft" pull-up or pull-down can be utilized to reduce the offset margins of gray level voltages to within ±5 mV.

5 Claims, 3 Drawing Sheets

THIN-FILM TRANSISTOR LIQUID CRYSTAL DISPLAY DEVICES THAT GENERATE GRAY LEVEL VOLTAGES HAVING REDUCED OFFSET MARGINS

RELATED APPLICATION

This application is related to Korean Application No. 98-13127, filed Apr. 13, 1998, the disclosure of which is hereby incorporated herein by reference.

FIELD OF THE INVENTION

The present invention relates to integrated circuit display devices, and more particularly to thin-film transistor (TFT) liquid crystal display (LCD) devices and methods of operating same.

BACKGROUND OF THE INVENTION

Thin-film transistor (TFT) liquid crystal display (LCD) devices typically include a display panel 11, a gate line driver circuit 12 and a data line driver circuit 10, as illustrated by FIG. 1. The display panel 11 typically comprises a two-dimensional array of display cells having TFT access transistors T1 therein which can be turned on when display data is being loaded from a respective data line DL 16 to a liquid crystal capacitor C1 within a selected cell. As illustrated, each liquid crystal capacitor C1 may be electrically connected in series between a drain/pixel electrode of a respective access transistor T1 and a common potential Vc. As will be understood by those skilled in the art, a row of access transistors can be turned on simultaneously during a selection time interval by driving a respective gate line 14 to a logic 1 potential. These and other aspects of TFT-LCD devices are more fully described in U.S. application Ser. No. 08/786,474, now U.S. Pat. No. 5,923,310, entitled "Liquid Crystal Display Devices With Increased Viewing Angle Capability and Methods of Operating Same", assigned to the present assignee, the disclosure of which is hereby incorporated herein by reference. Additional aspects of TFT-LCD devices are also disclosed in U.S. Pat. Nos. 5,793,346 entitled "Liquid Crystal Display Devices Having Active Screen Clearing Circuits Therein, U.S. Pat. No. 5,808,706, entitled "Thin-Film Transistor Liquid Crystal Display Devices Having Cross-Coupled Storage Capacitors", and U.S. Pat. No. 5,815,129, entitled "Liquid Crystal Display Devices Having Redundant Gate Line Driver Circuits Therein Which Can be Selectively Disabled", assigned to the present assignee, the disclosure of which is hereby incorporated herein by reference.

As will be understood by those skilled in the art, AC driving methods are typically used in TFT-LCD devices to inhibit display panel deterioration. Such AC driving methods include line inversion and dot inversion methods. Both of these methods require the use of data line driver circuits 10 which are capable of generating positive and negative polarity gray level voltages. The use of data line driver circuits which can generate gray level voltages having relatively small offset margins is advantageous because there is an inverse relationship between the magnitude of the offset margins and the number of shades of gray or color a display can generate.

Referring now to FIG. 2, a conventional 6-bit data line driver circuit is illustrated. This driver circuit is responsive to a polarity selection signal (POL) (which enables the AC driving method) and includes a decoder 20 which can generate $2^6$=64 gray level voltages as inputs to an follower amplifier circuit 24. These gray level voltages may be provided as positive or negative signals having respective magnitudes in a range from 1–5 volts (i.e., the 4 volt range is divided into 64 levels). Operation of this follower amplifier circuit 24, which is also typically referred to as a unity gain amplifier, is more fully described in section 3.5 of a textbook by A. Sedra and K. Smith entitled "Microelectronic Circuits", Holt, Rinehart & Winston (1982). A panel capacitor C26 is also illustrated. The panel capacitor is representative of the combined load capacitance associated with a respective data line which is electrically connected to the source electrodes of a column of TFT access transistors T1.

Unfortunately, although conventional follower amplifier circuits 24 may be capable of providing a significant amount of current to a data line (DL) to thereby provide "hard" pull-up or pull-down during a selection time interval when data is being loaded into a row of display cells, such circuits 24 may only be capable of reproducing a gray level input voltage Vin on the data line (DL) to within ±20 mV of its target level. Accordingly, it may be difficult to obtain higher display resolution fidelity using larger decoders 20 (e.g., 8 bit decoders) because a 4 volt range having $2^8$=256 levels would require much smaller offset margins on the order of ±5 mV.

Thus, notwithstanding the above-described TFT-LCD devices having data line driver circuits therein which can handle 6-bit data, there continues to be a need for higher resolution display devices.

SUMMARY OF THE INVENTION

It is therefore an object of the present invention to provide integrated circuit display devices having high resolution and methods of operating same.

It is another object of the present invention to provide thin-film transistor (TFT) liquid crystal display (LCD) devices which utilize large numbers of gray level voltages to display images and methods of operating same.

These and other objects, features and advantages of the present invention are provided by TFT-LCD display devices having improved data line driver circuits therein. These data line driver circuits can reliably provide an increased number of gray level voltages to a TFT-LCD display panel with reduced offset voltage margins and thereby enable greater image fidelity. The data line driver circuits preferably comprise an follower amplifier which drives a data line of a display panel "hard" during a first portion of a selection time interval (when a strong pull-up or pull-down is required) and a transmission gate which performs the final "soft" pull-up or pull-down of the data line to a desired gray level voltage during a second portion of the selection time interval. The "soft" pull-up or pull-down can be utilized to reduce the offset margins of gray level voltages to within ±5 mV. Here, the selection time interval corresponds to the time interval during which a gate line of a row of display cells in the display panel is active and the TFTs in the row are turned on.

According to one embodiment of the present invention, a display device is provided having an array of display cells and a data line electrically coupled to a column of display cells in the array. A decoder is also provided which outputs a first data line signal (Vin) having a magnitude equal to a first gray level voltage, in response to an N-bit data input signal (DIN). A data line driver circuit is also provided which drives the data line with buffered and unbuffered versions of the first data line signal during first and second consecutive portions of the selection time interval, respectively. According to preferred aspects of this embodiment, the data line driver circuit comprises a follower amplifier having an input electrically coupled to an output of the decoder and an output electrically coupled to the data line, and a transmission gate electrically connected in parallel with the follower amplifier. The data line driver circuit is also responsive to a buffer control signal (CONT). In particular, the follower amplifier is active as a buffer and the transmission gate is inactive when the buffer control signal is in a first logic state (e.g., logic 0) and the transmission gate is active and the follower amplifier is inactive when the buffer control signal is in a second logic state (e.g., logic 1) opposite the first logic state.

DESCRIPTION OF PREFERRED EMBODIMENTS

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. Like numbers refer to like elements throughout and signal lines and signals thereon may be referred to by the same reference symbols.

Figure 3:
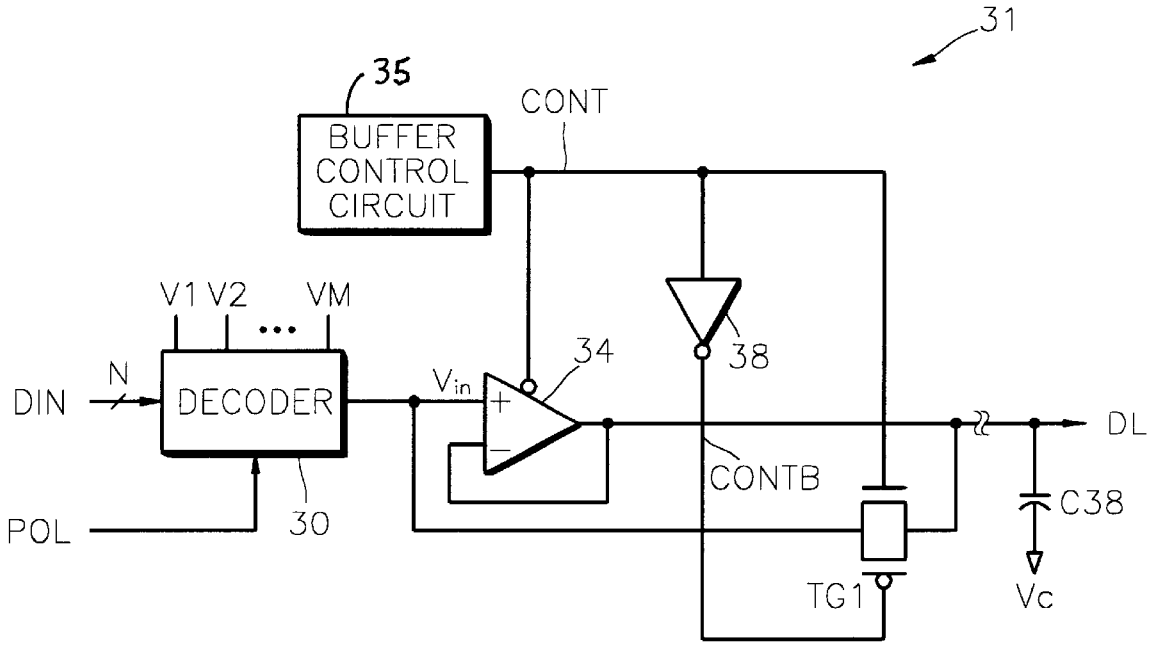
FIG. 3 is an electrical schematic of a data line driver circuit according to a first embodiment of the present invention.

Referring now to FIG. 3, a preferred TFT-LCD display device according to an embodiment of the present invention comprises decoder 30 which outputs a first data line signal (Vin) having a magnitude equal to a first gray level voltage during a first selection time interval, in response to an N-bit data input signal (DIN). In order to perform an AC driving method, the decoder 30 is made responsive to a polarity selection signal (POL). A data line driver circuit 31 is also provided which drives the data line with buffered and unbuffered versions of the first data line signal Vin during first and second consecutive portions of the first selection time interval, respectively.

According to preferred aspects of this embodiment, the data line driver circuit 31 comprises a follower amplifier 34 having an input electrically coupled to an output of the decoder 30 and an output electrically coupled to the data line DL, and a transmission gate TG1 electrically connected in parallel with the follower amplifier 34. The data line driver circuit 31 is also responsive to a buffer control signal (CONT), which is generated by a buffer control circuit 35. In particular, the follower amplifier is active and the transmission gate is inactive when the buffer control signal CONT is in a first logic state (e.g., logic 0). Alternatively, the transmission gate is active and the follower amplifier is inactive when the buffer control signal CONT is in a second logic state (e.g., logic 1) opposite the first logic state.

As described more fully hereinbelow, these driver circuits can reliably provide an increased number of gray level voltages with reduced offset voltage margins to a TFT-LCD display panel and thereby enable greater image fidelity. In particular, the data line driver circuit 31 comprises an follower amplifier 34 which drives the data line DL "hard" during a first portion T1 of the selection time interval Ts (when a strong pull-up or pull-down is required) and a transmission gate TG1 which performs the final "soft" pull-up or pull-down of the data line to a desired gray level voltage during a second portion T2 of the selection time interval Ts. The "soft" pull-up or pull-down can be utilized to reduce the offset margins of the gray level voltages to within ±5 mV. The selection time interval corresponds to the time interval during which a gate line of a row of display cells in the panel is active and the TFTs in the row are turned on. Operation of a TFT-LCD device during a selection time interval is more fully described in the aforementioned '474 application, now U.S. Pat. No. 5,923,310.

Referring still to FIG. 3, the transmission gate TG1 is preferably a CMOS transmission gate which is responsive to the buffer control signal CONT and a complementary buffer control signal CONTB which is generated by an inverter 38. A panel capacitor C38 is representative of the combined load capacitance associated with the data line DL.

Operation of a preferred TFT-LCD device will now be more fully described. The decoder 30 receives and decodes input data DIN having a width of N bits and outputs the data line signal Vin at a level which corresponds to the value of the input data DIN. For example, when the input data is 8 bits wide, the decoder 30 can output 256 gray level voltages having positive polarity (+) or negative polarity (−) depending on the value of the polarity selection signal POL. If the polarity selection signal POL is at a logic 1 level, Vin will be positive and if POL is at a logic 0 level, Vin will be negative.

Figure 4:
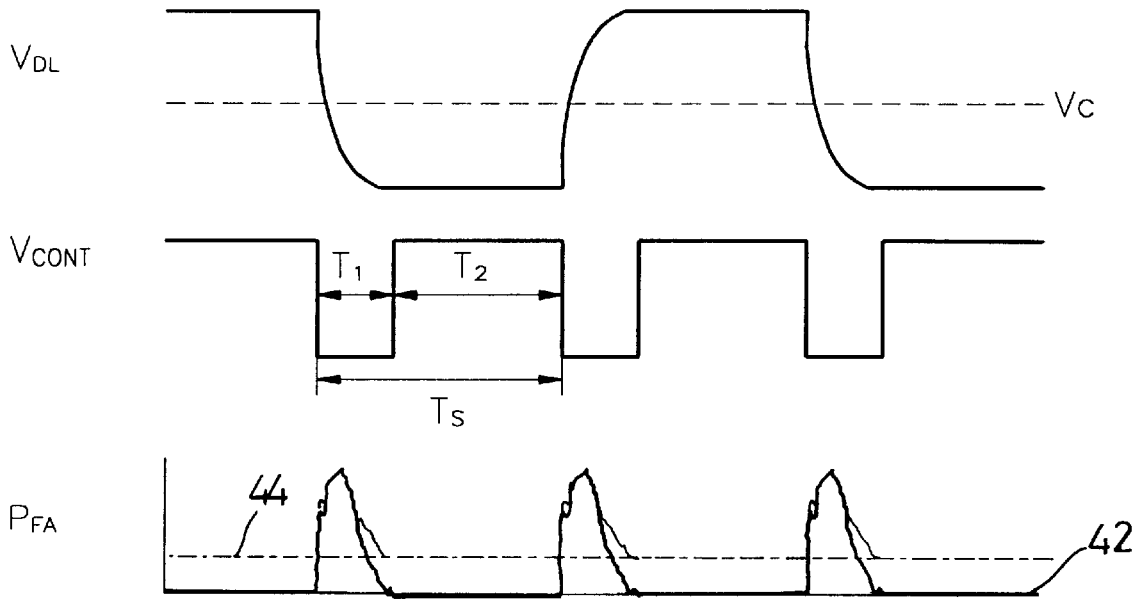
FIG. 4 is a timing diagram which illustrates operation of the data line driver circuit of FIG. 3.

When the buffer control signal CONT is at a logic 0 level, the follower amplifier 34 acts as a buffer by current-amplifying the data line signal Vin. When the buffer control signal CONT is at a logic 1 level, the follower amplifier 34 becomes inactive and does not amplify the data line signal Vin. Instead, the transmission gate TG1 passes an unbuffered version of the data line signal Vin to the data line DL. According to a preferred aspect of the present invention and as illustrated by FIG. 4, the buffer control signal CONT is set to a logic 0 level at the beginning of a respective selection time interval Ts (when display data is to be loaded into a row of display cells in the array). The logic 0 level is maintained until the voltage magnitude of the signal on the data line DL reaches an approximation of a desired target level. Here, the point of approximation can be defined as a voltage corresponding to 99% of the target level, and can be set to a level within ±20 mV of the target level. When the output of the follower amplifier 34 reaches the approximation of the target level, the buffer control signal CONT is switched to a logic 1 level. When this occurs, the transmission gate TG1 is turned on. This enables the output of the decoder 30 to provide the final unbuffered pull-up or pull-down of the data line DL to within ±5 mV of the target level, for example.

Figure 1:
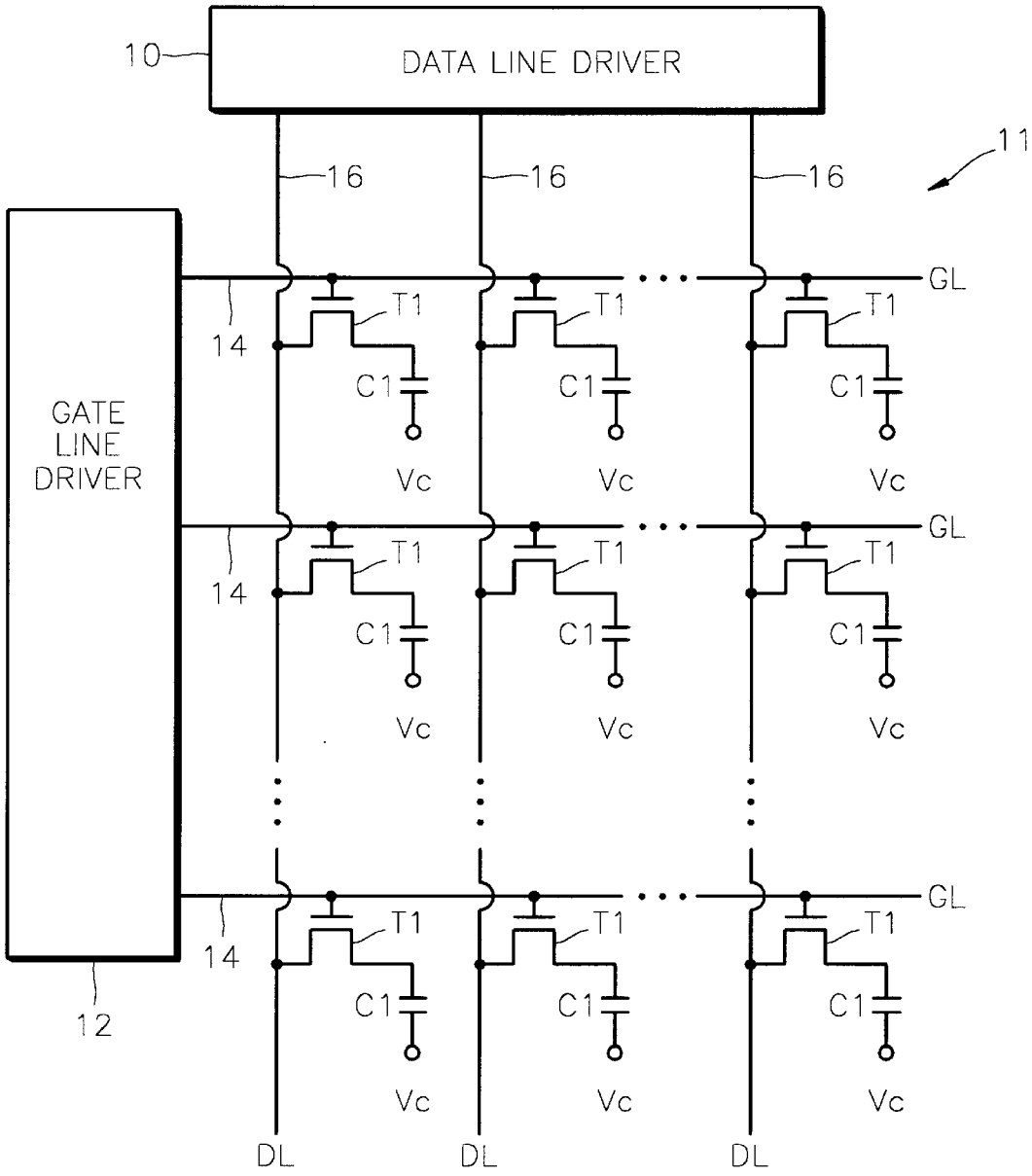
FIG. 1 (PRIOR ART)
FIG. 1 is an electrical schematic of a conventional thin-film transistor (TFT) liquid crystal display (LCD) device.
Figure 2:
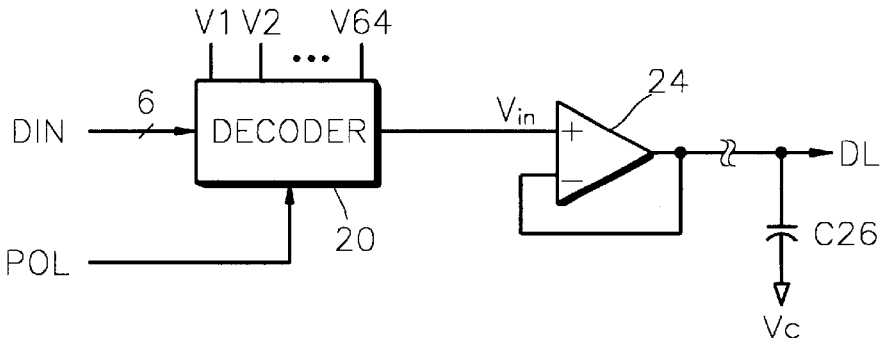
FIG. 2 (PRIOR ART)
FIG. 2 is an electrical schematic of a conventional data line driver circuit which can be used in the display device of FIG. 1.

The timing of the buffer control signal CONT may be influenced by the rise time and fall time of the output of the follower amplifier 34. For example, if one of the target gray levels associated with an 8-bit word (i.e., one of 256 gray levels) is provided as a +1.5 V signal to the input of the follower amplifier 34, the buffer control signal CONT may remain at a logic 0 potential until the voltage on the data line (VDL) is established at a level equal to 99% of the target level of 1.5 V. When the output of the follower amplifier 34 reaches the 99% level, the buffer control signal CONT will transition from 0→1. This will cause the follower amplifier 34 to switch off (thereby reducing power consumption during the latter portion of the selection time interval Ts) and the transmission gate TG1 to switch on. This reduction in the amount of power consumed by the follower amplifier 34 of FIG. 3 relative to the follower amplifier 24 of FIG. 2 is best illustrated by power signals (PFA) in FIG. 4. In particular, signal 44 represents the power consumed by the follower amplifier 24 of FIG. 2 and signal 42 represents the reduced amount of power consumed by the follower amplifier 34 of FIG. 3. In the data line driver circuit of FIG. 3, the follower amplifier 34, the inverter 38 and the transmission gate TG1 can be incorporated into a single selective amplifier. In such an amplifier, the buffer control signal CONT may be referred to as an amplification control signal.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A display device, comprising:

an array of display cells;

a data line electrically coupled to at least one display cell in said array thereof;

a decoder that outputs a first data line signal having a magnitude equal to a first gray level voltage during a first selection time interval, in response to a data input signal;

a data line driver circuit that drives said data line with buffered and unbuffered versions of the first data line signal during first and second consecutive portions of the first selection time interval, respectively, said data line driver circuit comprising:

a follower amplifier having an input electrically coupled to an output of said decoder and an output electrically coupled to said data line; and a transmission gate having an input electrically coupled to the output of said decoder and an output electrically coupled to said data line; and a buffer control circuit that is electrically coupled to said follower amplifier and said transmission gate and generates a control signal having a first state that enables said follower amplifier and disables said transmission gate during the first portion of the selection time interval and a second state that disables said follower amplifier and enables said transmission gate during the second portion of the selection time interval.

2. The display device of claim 1, wherein the data input signal is an N-bit signal and N is greater than six.

3. The device of claim 1, further comprising:

an array of thin-film transistor display cells; and wherein said data line is electrically connected to a source of at least one of the display cells in said array.

4. A display device, comprising:

an array of display cells;

a data line electrically coupled to at least one display cell in said array thereof;

a data line driver circuit that drives said data line with buffered and unbuffered versions of a first data line signal during first and second consecutive portions of a selection time interval, respectively, said data line driver circuit comprising:

a follower amplifier having an input that receives the first data line signal and an output electrically coupled to said data line; and a transmission gate having an output electrically coupled to said data line; and a buffer control circuit that is electrically coupled to said follower amplifier and said transmission gate and generates a control signal having a first state that enables said follower amplifier and disables said transmission gate during the first portion of the selection time interval and a second state that disables said follower amplifier and enables said transmission gate during the second portion of the selection time interval.

5. A display device, comprising:

an array of display cells;

a data line electrically coupled to at least one display cell in said array thereof;

a buffer control circuit that generates a control signal having leading and trailing edges; and a data line driver circuit that drives said data line with buffered and unbuffered versions of a first data line signal during first and second consecutive portions of a selection time interval, respectively, in response to the control signal, said data line driver circuit comprising:

a follower amplifier that has an input that receives the first data line signal and an output that is electrically coupled to said data line, is enabled during the first portion of the selection time interval and is disabled in-sync with the leading or trailing edge of the control signal; and a transmission gate that has an input that receives the first data line signal and an output electrically coupled to said data line, is disabled during the first portion of the selection time interval and is enabled in-sync with the leading or trailing edge of the control signal.

* * * * *

UNITED STATES PATENT AND TRADEMARK OFFICE

CERTIFICATE OF CORRECTION

PATENT NO. : 6,331,847 B1
DATED : December 18, 2001
INVENTOR(S) : Kim et al.

It is certified that error appears in the above-identified patent and that said Letters Patent is hereby corrected as shown below:

Column 5,
Line 43, please add -- directly -- after "coupled".

Column 6,
Line 20, please add -- directly -- after "coupled".

Signed and Sealed this

Twenty-third Day of April, 2002

*Attest:*

*Attesting Officer*

JAMES E. ROGAN
*Director of the United States Patent and Trademark Office*